US010186206B2

(12) United States Patent
Sung et al.

(10) Patent No.: US 10,186,206 B2
(45) Date of Patent: Jan. 22, 2019

(54) DISPLAY DEVICE

(71) Applicant: Samsung Display Co., Ltd., Yongin-si, Gyeonggi-do (KR)

(72) Inventors: Seung Woo Sung, Incheon (KR); Hyun-Chol Bang, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 140 days.

(21) Appl. No.: 14/857,523

(22) Filed: Sep. 17, 2015

(65) Prior Publication Data

US 2016/0307494 A1 Oct. 20, 2016

(30) Foreign Application Priority Data

Apr. 16, 2015 (KR) ..... 10-2015-0053964

(51) Int. Cl.
*G09G 3/3291* (2016.01)
*G09G 3/00* (2006.01)

(52) U.S. Cl.
CPC ..... *G09G 3/3291* (2013.01); *G09G 3/006* (2013.01); *G09G 2300/0426* (2013.01); *G09G 2310/0297* (2013.01); *G09G 2330/12* (2013.01)

(58) Field of Classification Search
CPC ..... G09G 3/22; G09G 3/3208; G09G 3/30; G09G 3/3225; G09G 3/3233; G09G 3/3241; G09G 3/3266; G09G 3/3275; G09G 3/3258
See application file for complete search history.

(56) References Cited

U.S. PATENT DOCUMENTS 7,619,620 B2 * 11/2009 Fujita ..... G09G 3/006 345/204
7,911,426 B2 * 3/2011 Eom ..... G09G 3/32 345/77
9,430,964 B2 * 8/2016 Jeong ..... G09G 3/3208
9,495,893 B2 * 11/2016 Park ..... G09G 3/006
9,514,673 B2 * 12/2016 Kwon ..... G09G 3/3208
9,530,374 B2 * 12/2016 Jeong ..... G09G 3/3688
9,543,544 B2 * 1/2017 Lee ..... H01L 51/5253
2004/0004444 A1 * 1/2004 Choi ..... G09G 3/3208 315/169.2
2006/0001622 A1 * 1/2006 Kim ..... G09G 3/3266 345/76

(Continued)

FOREIGN PATENT DOCUMENTS

KR 10-0732819 B1 6/2007
KR 10-2007-0120385 A 12/2007
KR 10-2009-0105450 A 10/2009

*Primary Examiner* — William Lu

(57) ABSTRACT

A display device is disclosed. In one aspect, the display device includes a data driver configured to generate an output signal corresponding to input image data, a signal divider configured to divide the output signal into a plurality of data signals, and provide the data signals to a plurality of pixels and a display unit including a matrix of pixels configured to receive the data signals. The signal divider includes a first via hole formed over a first source/drain wire configured to receive a driving voltage of each pixel, a second via hole formed over a second source/drain wire of the pixel and a pixel wire electrically connecting the first and second source/drain wires to each other respectively through the first via hole and the second via hole.

18 Claims, 4 Drawing Sheets

(56) References Cited

U.S. PATENT DOCUMENTS

2006/0060851 A1* 3/2006 Kawata ..... G09G 3/006
257/59
2006/0267885 A1* 11/2006 Kwak ..... G09G 3/3233
345/76
2006/0274570 A1* 12/2006 Jeoung ..... G09G 3/006
365/154
2007/0168147 A1* 7/2007 Cannon ..... G06F 11/24
702/117
2009/0079464 A1* 3/2009 Yoshii ..... G02F 1/136204
324/760.01
2009/0273388 A1* 11/2009 Yamashita ..... G09G 3/3648
327/416
2012/0306520 A1* 12/2012 Liao ..... G09G 3/006
324/750.16
2013/0314624 A1 11/2013 Li et al.
2014/0085349 A1* 3/2014 Shiibayashi ..... G09G 5/10
345/690
2014/0241487 A1* 8/2014 Yamazaki ..... G11C 19/28
377/54
2015/0008937 A1* 1/2015 Lee ..... G09G 3/3225
324/539

* cited by examiner

DISPLAY DEVICE

INCORPORATION BY REFERENCE TO ANY PRIORITY APPLICATIONS

This application claims priority to and the benefit of Korean Patent Application No. 10-2015-0053964 filed in the Korean Intellectual Property Office on Apr. 16, 2015, the entire contents of which are incorporated herein by reference.

BACKGROUND

Field

The described technology generally relates to a display device.

Description of the Related Technology

In general, flat panel displays have replaced cathode-ray tube displays because of their favorable characteristics such as lightness, thinness, and the like. Examples of types of such display devices include liquid crystal displays (LCDs) and organic light-emitting diode (OLED) displays. An OLED forms excitons by recombining electrons and holes injected through a cathode and an anode on an organic thin film and uses a phenomenon that generates light with a specific wavelength by energy provided by the excitons. Compared to a liquid crystal display, it has excellent luminance and viewing angle, and it requires no backlight, so it has a relatively thin profile. In a flat panel display, a row of pixels commonly connected to one scan line are connected to different data lines. Accordingly, if the number of pixels arranged in the direction of the scan lines and the direction of the data lines are increased in order to improve resolution, the number of data lines is increased proportionally to the number of pixels. Consequently, there are problems in that the number of data driving circuits included in a gate driver increases, such that the manufacturing cost also increases. To solve this problem, a demultiplexer for selectively outputting an input signal to one of a plurality of output lines is used to sequentially apply data signals generated by a data driver to a plurality of data lines, and thereby reduce the number of data driving circuits included in the data driver.

However, in a typical demultiplexer, a turning-on test unit and related wiring are included, which increases dead space in the panel.

The above information disclosed in this Background section is only to enhance the understanding of the background of the described technology, and therefore it can contain information that does not form the prior art that is already known in this country to a person of ordinary skill in the art.

SUMMARY OF CERTAIN INVENTIVE ASPECTS

One inventive aspect relates to reducing dead space in a display device.

One inventive aspect relates to a display device including: a data driver for generating an output signal corresponding to input image data; a signal divider for generating a plurality of data signals based on the output signal, and applying the data signals to corresponding pixels from among the pixels; and a display unit configured with a plurality of pixels to which the data signals are applied, wherein the signal divider includes: a first via hole formed over a source/drain wire to which a driving voltage of the pixel is applied; a second via hole formed over a source/drain wire of the pixel; and a pixel wire for electrically connecting the source/drain wire and the source/drain wire of the pixel through the first via hole and the second via hole.

The signal divider is provided between the data driver and the display unit.

The signal divider includes a first planarization layer provided on the source/drain wire, and the first via hole is formed by etching the first planarization layer to expose the source/drain wire.

The signal divider includes a second planarization layer formed on the source/drain wire of the pixel, and the second via hole is formed by etching the second planarization layer to expose the source/drain wire of the pixel.

The signal divider includes a turning-on test unit, and the turning-on test unit generates a test data signal and applies the same to the plurality of pixels.

The signal divider includes a demultiplexer unit, and the demultiplexer unit supplies an output signal to generate the data signals.

Another aspect is a display device, comprising: a data driver configured to generate an output signal corresponding to input image data; a signal divider configured to divide the output signal into a plurality of data signals, and provide the data signals to a plurality of pixels; and a display unit including a matrix of pixels configured to receive the data signals, wherein the signal divider includes: a first via hole formed over a first source/drain wire configured to receive a driving voltage of each pixel; a second via hole formed over a second source/drain wire of the pixel; and a pixel wire electrically connecting the first and second source/drain wires to each other respectively through the first via hole and the second via hole.

In the above display device, the signal divider is located between the data driver and the display unit. In the above display device, each of the pixel wires includes first and second ends opposing each other, wherein the signal divider further includes a planarization layer including a first portion formed over the first source/drain wire, and wherein the first via hole is formed in a first etched portion of the first planarization layer where the first end of the pixel wire is located. In the above display device, the planarization layer further includes a second portion formed over the second source/drain wire, and wherein the second via hole is formed in a second etched portion of the planarization layer where the second end of the pixel wire is located.

In the above display device, the signal divider further includes a turning-on test unit configured to generate and provide a test data signal to the pixels. In the above display device, the signal divider includes a demultiplexer configured to receive the output signal and generate the data signals based on the output signal. The above display device further comprises a third source/drain wire formed between the first and second source/drain wires. The above display device further comprises a third source/drain wire formed below the pixel wire in the depth dimension of the display device. The above display device further comprises a signal controller configured to provide a plurality of control signals to the data driver, the signal divider and the scan driver based on the input image data.

Another aspect is a display device, comprising: a display unit including a matrix of pixels; and a signal divider configured to generate a plurality of data signals and provide the data signals to a plurality of pixels, wherein the signal divider includes: a first wire configured to receive a driving voltage of each of the pixels; a second wire configured to receive the driving voltage and spaced apparat from the first wire; and a pixel wire electrically connecting the first and second wire to each other.

The above display device further comprises a plurality of third wires formed below the pixel wire in the depth dimension of the display device. In the above display device, the third wires are located at least in part between the first and second wires. The above display device further comprises: a plurality of thin-film transistors (TFT) including a TFT layer; and an insulating layer formed between the TFT layer and the first to third wires so as to electrically insulate the TFT layer from the first to third wires. In the above display device, the first and third wires have substantially the same thickness. In the above display device, the first wire is thinner than the second wire. The above display device further comprises a data driver configured to generate and provide a plurality of output signals to the signal divider, wherein the signal divider is located between the data driver and the display unit.

Another aspect is a display device, comprising: a display unit including a matrix of pixels; and a signal divider configured to generate a plurality of data signals and provide the data signals to corresponding pixels among the pixels, wherein the signal divider includes: a driving voltage wire unit configured to receive a driving voltage from a power source via a first wire; a pixel wire unit configured to provide the data signals to the pixels; and a demultiplexer formed between the driving voltage wire unit and the pixel wire unit and configured to electrically connect the driving voltage wire unit to the pixel wire unit.

In the above display device, the driving voltage wire unit includes a first wire, wherein the pixel wire unit includes a second wire, and wherein the demultiplexer includes a third wire. The above display device further comprises a planarization layer formed over a portion of the first wire and a portion of the second wire, wherein the pixel wire directly contacts the first wire through a first via hole where the planarization layer is not formed, and wherein the pixel wire directly contacts the second wire through a second via hole where the planarization is not formed. In the above display device, the planarization layer is further formed over in the demultiplexer, and wherein the thickness of the planarization layer in the demultiplexer is greater than each of the thicknesses of the planarization layer formed over the first and second wires.

According to at least one of the disclosed embodiments, the display device reduces dead space in the display device.

DETAILED DESCRIPTION OF CERTAIN INVENTIVE EMBODIMENTS

Figure 1:
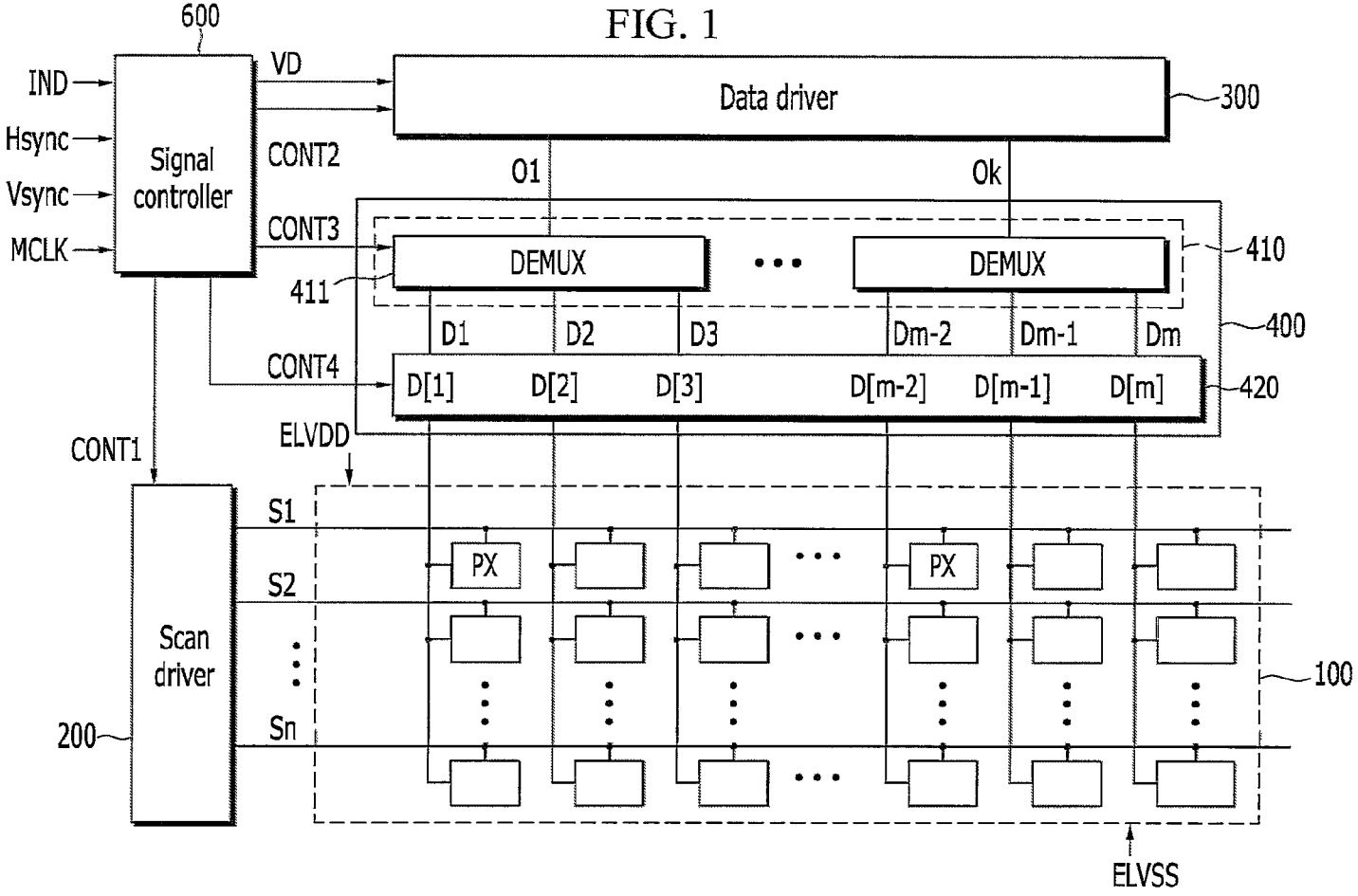
FIG. 1 shows a display device according to exemplary embodiment.

Hereinafter, exemplary embodiments disclosed in the present specification will be described in detail with reference to the accompanying drawings. In the present specification, the same or similar components will be denoted by the same or similar reference numerals, and a duplicate description thereof will be omitted. The terms "module" and "unit" for components used in the following description are used only in order to make the specification easier. Therefore, these terms do not have meanings or roles that distinguish them from each other by themselves. In describing exemplary embodiments of the present specification, when it is determined that a detailed description of the well-known art associated with the described technology can obscure the gist of the described technology, it will be omitted. The accompanying drawings are provided only in order to allow exemplary embodiments disclosed in the present specification to be easily understood and are not to be interpreted as limiting the spirit disclosed in the present specification, and it is to be understood that the described technology includes all modifications, equivalents, and substitutions without departing from the scope and spirit of the described technology.

Terms including ordinal numbers such as first, second, and the like, will be used only to describe various components, and are not interpreted as limiting these components. The terms are only used to differentiate one component from other components.

It is to be understood that when one component is referred to as being "connected" or "coupled" to another component, it can be connected or coupled directly to another component or be connected or coupled to another component with the other component intervening therebetween. On the other hand, it is to be understood that when one component is referred to as being "connected or coupled directly" to another component, it can be connected to or coupled to another component without any other component intervening therebetween.

Singular forms are to include plural forms unless the context clearly indicates otherwise.

It will be further understood that terms "comprises" or "have" used in the present specification specify the presence of stated features, numerals, steps, operations, components, parts, or a combination thereof, but do not preclude the presence or addition of one or more other features, numerals, steps, operations, components, parts, or a combination thereof.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements can also be present. In contrast, when an element is referred to as being "directly on" another element, there are no intervening elements present. In this disclosure, the term "substantially" includes the meanings of completely, almost completely or to any significant degree under some applications and in accordance with those skilled in the art. The term "connected" can include an electrical connection.

FIG. 1 shows a display device according to exemplary embodiment of the described technology.

Depending on the embodiment, certain elements can be removed from or additional elements can be added to the system illustrated in FIG. 1. Furthermore, two or more elements can be combined into a single element, or a single element can be realized as multiple elements. Some or all of each of the elements of FIG. 1 can be implemented as a hardware and/or a software module.

Referring to FIG. 1, the display device 1 includes a plurality of scanning lines (S1-Sn), a plurality of data lines (D1-Dm), a display unit 100, a scan driver 200, a data driver 300, a signal divider 400, a signal controller 600, and a matrix of pixels PX.

The scanning lines (S1-Sn) (n is a natural number) are arranged in a vertical direction and extend in a horizontal direction. The data lines (D1-Dm) (m is a natural number) are arranged in the horizontal direction extend in the vertical direction. A plurality of output lines (O1-Ok) (k is a natural number) are arranged in the horizontal direction and extend in the vertical direction.

The display unit 100 is connected to the scanning lines (S1-Sn) and the data lines (D1-Dm), and includes the pixels PX. A first driving voltage (or power source) (ELVDD) and a second driving voltage (ELVSS) for emitting the pixels PX are applied to the display unit 100.

The scan driver 200 is connected to the scanning lines (S1-Sn), and sequentially applies a plurality of scanning signals (S[1]-S[n]) to the scanning lines (S1-Sn) according to a scan control signal CONT1.

The data driver 300 is connected to the output lines (O1-Ok). The data driver 300 generates a plurality of output signals (O[1])-O[k]) (e.g., output voltages) corresponding to image data (VD) input according to a data driving control signal CONT2 and applies the same to the signal divider 400.

The signal divider 400 includes a demultiplexer unit 410 and a turning-on test unit 420.

The demultiplexer unit 410 is connected between the output lines (O1-Ok) and the data lines (D1-Dm), and supplies the output signals (O[1]-O[k]) to corresponding data lines from among the data lines (D1-Dm) according to a data supplying control signal CONT3. For this purpose, the demultiplexer unit 410 includes a plurality of demultiplexers 411 corresponding to the pixels PX.

For ease of description, FIG. 1 shows that one demultiplexer 411 supplies data signals to three pixels PX, but embodiments are not limited thereto.

The turning-on test unit 420 applies test data signals (DT[1]-DT[m]) for testing the turning-on of the pixels PX to the data lines (D1-Dm) according to a turning-on test control signal CONT4. The turning-on test unit 420 is provided between the demultiplexer unit 410 and the display unit 100 and is connected to the data lines (D1-Dm). Therefore, an additional signal line for driving the turning-on test unit 420 does not need to bypass the display unit 100, and thus dead space can be reduced.

The signal controller 600 receives an external input data (InD) and a synchronization signal, and generates a scan control signal CONT1, a data driving control signal CONT2, a data supplying control signal CONT3, a turning-on test control signal CONT4, and image data (VD). The external input data (InD) includes luminance information of the pixel PX, and the luminance has a predetermined number (e.g., $1024(=2^{10})$, $256(=2^{8})$, or $64(=2^{6})$ of grays. The synchronization signal includes a horizontal synchronizing signal Hsync, a vertical synchronization signal Vsync, and a main clock signal MCLK. The signal controller 600 distinguishes the external input data (InD) for each frame according to the vertical synchronization signal Vsync. The signal controller 600 distinguishes the external input data (InD) for each scan line according to the horizontal synchronizing signal Hsync to generate image data (DATA1).

The pixels PX respectively display an image, and more specifically, one pixel can uniquely display one primary color (spatial division), or the pixels can alternately display primary colors over time (temporal division) so that a spatial sum or a temporal sum of the primary colors can be displayed as a desired color. The pixels PX are synchronized with corresponding scanning signals and receive data signals (D[1])-D[m]) or test data signals (DT[1]-DT[m]) from the corresponding data lines. The data signals (D[1])-D[m]) or the test data signals (DT[1]-DT[m]) input to the pixels PX are programmed to the pixels PX according to the corresponding scanning signals. The pixels PX emit light with driving currents corresponding to the data signals (D[1])-D[m]) or the test data signals (DT[1]-DT[m]).

The pixels PX can include a blue pixel for displaying blue, a red pixel for displaying red, and a green pixel for displaying green, but embodiments are not limited thereto, and they can include pixels for displaying other colors as well as red, green, and blue.

Figure 2:
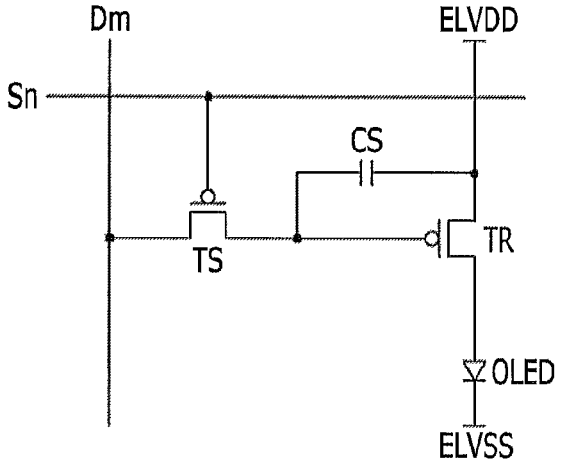
FIG. 2 shows a schematic diagram of one of the pixels of FIG. 1.

FIG. 2 shows a schematic diagram of one of the pixels of FIG. 1.

A pixel according to an exemplary embodiment will now be described with reference to FIG. 2.

As shown in FIG. 2, the pixel PX includes a switching transistor (TS), a driving transistor (TR), a storage capacitor (CS), and an organic light-emitting diode (OLED).

The switching transistor (TS) includes a gate electrode connected to the scanning line Sn, a first electrode connected to the data line D1, and a second electrode connected to a gate electrode of the driving transistor (TR).

The driving transistor (TR) includes a gate electrode connected to the second electrode of the switching transistor (TS), a source electrode for receiving the first driving voltage (ELVDD), and a drain electrode connected to an anode of the OLED.

The storage capacitor (CS) is connected between the gate electrode and the source electrode of the driving transistor (TR).

The second driving voltage (ELVSS) is applied to the cathode of the OLED.

When the switching transistor (TS) is turned on by a scanning signal with a gate-on voltage transmitted through the scanning line (Sn), a data signal or a test data signal is transmitted to the gate electrode of the driving transistor (TR) through the switching transistor (TS). A voltage caused by the data signal or the test data signal transmitted to the gate electrode of the driving transistor (TR) is maintained by the storage capacitor (CS). A driving current corresponding to the voltage maintained by the storage capacitor (CS) flows to the driving transistor (TR). The driving current flows to the OLED, and the OLED emits light with luminance corresponding to the driving current.

Figure 3:
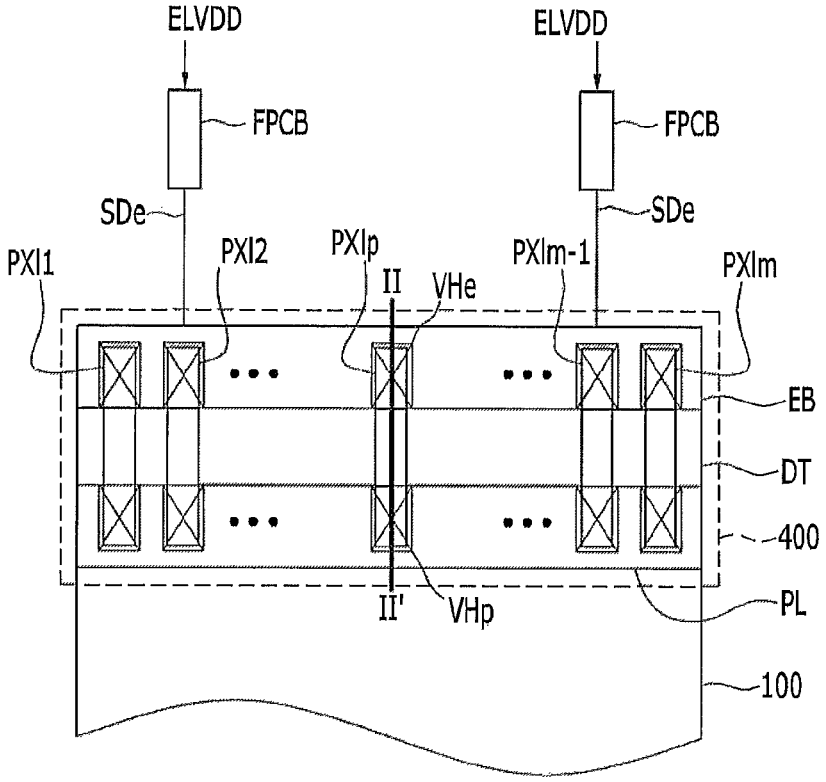
FIG. 3 shows a signal divider of the display device according to one embodiment.
Figure 4:
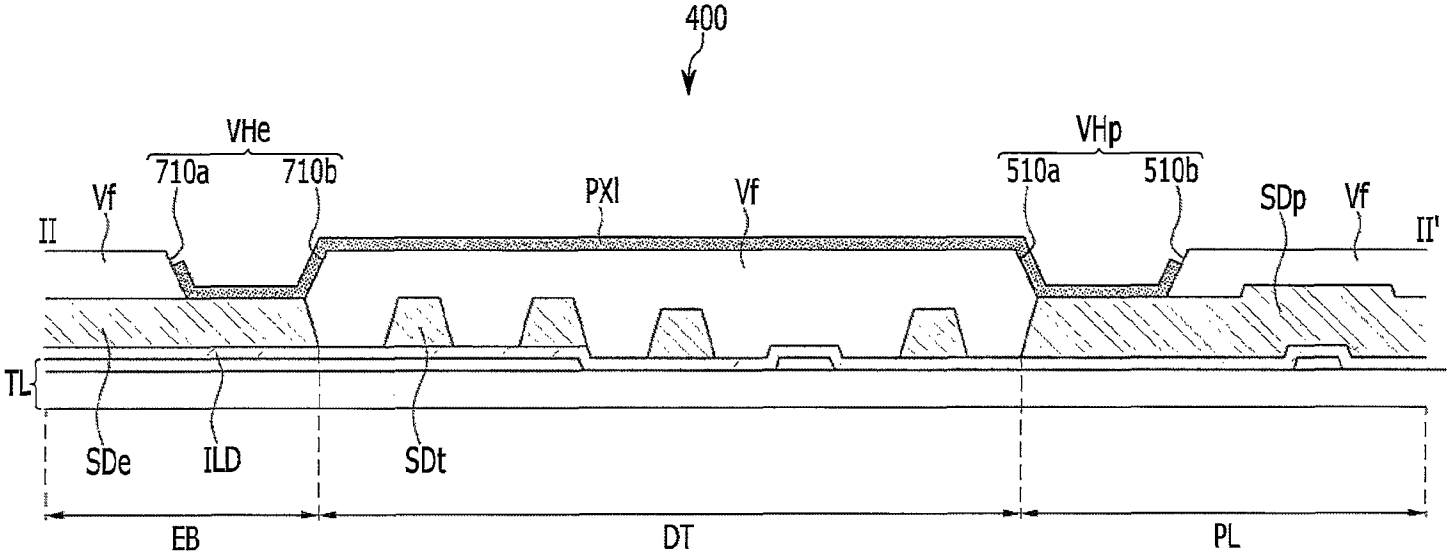
FIG. 4 shows a cross-sectional view of the signal divider of FIG. 3 with respect to line II-II.

FIG. 3 shows a signal divider. FIG. 4 shows a cross-sectional view of the signal divider of FIG. 3 with respect to line II-II.

A signal divider according to an exemplary embodiment will now be described with reference to FIG. 3 and FIG. 4.

Referring to FIG. 3, the signal divider 400 includes a driving voltage wire unit (EB), a turning-on test unit and demultiplexer unit (DT), a pixel wire unit (PL), and a plurality of pixel wires (PXl1-PXlm).

The driving voltage wire unit (EB) includes a plurality of via holes (VHe). The driving voltage wire unit (EB) includes a source/drain wire (or first source/drain wire or first wire) (SDe, refer to FIG. 4), and the first driving voltage (ELVDD) is applied to the source/drain wire (SDe) through a flexible printed circuit board (FPCB).

The turning-on test unit and demultiplexer unit (DT) include a demultiplexer unit 410 and a turning-on test unit 420 described with reference to FIG. 1.

The pixel wire unit (PL) includes a plurality of via holes (VHp). The pixel wire unit (PL) includes a plurality of source/drain wires (or second source/drain wires or second wires) (SDp, refer to FIG. 4), and a plurality of source/drain wires (SDp) are connected to the source electrode or the drain electrode of the driving transistor (TR) of the corresponding pixel PX from among the pixels PX.

The pixel wires (PXl1-PXlm) electrically connect a corresponding via hole (VHe) from among the via holes (VHe) and a corresponding via hole (VHp) from among the via holes (VHp). Therefore, the first driving voltage (ELVDD) is applied to the source/drain wire (SDp) through the pixel wires (PXl1-PXlm).

Referring to FIG. 4, the signal divider 400 includes a TFT layer (TL) including a driving transistor (TR), and an inter-layer dielectrics (ILD) formed on the TFT layer (TL) and performing an inter-layer insulation of the TFT layer (TL). The signal divider 400 also includes source/drain wires (SDe, SDt and SDp) formed on the inter-layer dielectrics (ILD) and connected to the source electrode or the drain electrode of the driving transistor (TR). The signal divider 400 further includes a planarization layer (Vf) formed on the source/drain wires (SDe, SDt, and SDp), via holes (VHe and VHp) formed by etching the planarization layer (Vf), and a pixel wire (PXL). The source/drain wire (SDt) is also called the third source/drain wire or the third wire.

The source/drain wires (SDe, SDt, and SDp) can be formed to be triple layers (Ti/Al/Ti) formed of titanium, aluminum, and titanium, but the embodiment are not limited thereto.

A first via hole (VHe) and a second via hole (VHp) are formed in the planarization layer (Vf). The first via hole (VHe) includes an etched side 710*a* of the driving voltage wire unit (EB) and an etched side 710*b* of the turning-on test unit and demultiplexer unit (DT), and exposes the source/drain wire (SDe) of the driving voltage wire unit (EB).

The second via hole (VHp) includes an etched side 510*a* of the turning-on test unit and demultiplexer unit (DT) and an etched side 510*b* of the pixel wire unit (PL), and exposes the source/drain wire (SDp) of the pixel wire unit (PL).

The pixel wire (PXL) includes a first terminal for electrically contacting the source/drain wire (SDe) through the first via hole (VHe) and a second terminal for electrically contacting the source/drain wire (SDp) through the second via hole (VHp). The pixel wire (PXL) transmits the first driving voltage (ELVDD) to the source/drain wire (SDp). The pixel wire (PXL) can be formed to be triple layers (ITO/Ag/ITO) of a transparent electrode, silver, and a transparent electrode, but the embodiments are not limited thereto.

While this inventive technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, the above detailed description is not to be interpreted as being restrictive, but is to be considered as being illustrative. The scope of the present invention is to be determined by reasonable interpretation of the claims, and all alterations within equivalences of the present invention fall within the scope of the present invention.

What is claimed is:

1. A display device, comprising:

a data driver configured to generate an output signal corresponding to input image data;

a signal divider configured to divide the output signal into a plurality of data signals, and provide the data signals to a plurality of pixels; and a display unit including the pixels configured to receive the data signals, wherein the signal divider includes:

a first via hole formed over a first source/drain wire configured to receive a driving voltage of the pixels from a power source;

a second via hole formed over a second source/drain wire configured to receive the driving voltage of the pixels;

a pixel wire electrically connecting the first and second source/drain wires to each other respectively through the first via hole and the second via hole;

a demultiplexer configured to receive the output signal; and a test unit configured to generate and provide a test data signal to the pixels, wherein the test unit is provided between the demultiplexer and the display unit, wherein each of the pixels has a driving transistor, and the second source/drain wire is connected to a source electrode of the driving transistor.

2. The display device of claim 1, wherein the signal divider is located between the data driver and the display unit.

3. The display device of claim 2, wherein each of the pixel wires includes first and second ends opposing each other, wherein the signal divider further includes a planarization layer including a first portion formed over the first source/drain wire, and wherein the first via hole is formed in a first etched portion of the first planarization layer where the first end of the pixel wire is located.

4. The display device of claim 3, wherein the planarization layer further includes a second portion formed over the second source/drain wire, and wherein the second via hole is formed in a second etched portion of the planarization layer where the second end of the pixel wire is located.

5. The display device of claim 1, wherein the demultiplexer is configured to generate the data signals based on the output signal.

6. The display device of claim 1, further comprising a third source/drain wire formed between the first and second source/drain wires.

7. The display device of claim 1, further comprising a third source/drain wire formed below the pixel wire in the depth dimension of the display device.

8. The display device of claim 1, further comprising a signal controller configured to provide a plurality of control signals to the data driver, the signal divider and the scan driver based on the input image data.

9. A display device, comprising:

a display unit including a matrix of pixels; and a signal divider configured to generate a plurality of data signals and provide the data signals to the pixels, wherein the signal divider includes:

a first wire configured to receive a driving voltage of each of the pixels from a power source;

a second wire configured to receive the driving voltage and spaced apart from the first wire;

a pixel wire electrically connecting the first and second wire to each other;

a demultiplexer configured to receive the output signal;

a test unit configured to generate and provide a test data signal to the pixels, wherein the test unit is provided between the demultiplexer and the display unit, each of the pixels has a driving transistor, and the second source/drain wire is connected to a source electrode of the driving transistor.

10. The display device of claim 9, further comprising a plurality of third wires formed below the pixel wire in the depth dimension of the display device.

11. The display device of claim 10, wherein the third wires are located at least in part between the first and second wires.

12. The display device of claim 10, further comprising:

a plurality of thin-film transistors (TFT) including a TFT layer; and an insulating layer formed between the TFT layer and the first to third wires so as to electrically insulate the TFT layer from the first to third wires.

13. The display device of claim 10, wherein the first and third wires have substantially the same thickness.

14. The display device of claim 13, wherein the first wire is thinner than the second wire.

15. A display device, comprising:

a display unit including a matrix of pixels; and a signal divider configured to generate a plurality of data signals and provide the data signals to corresponding pixels among the pixels, wherein the signal divider includes:

a driving voltage wire unit configured to receive a driving voltage from a power source via a first wire from the power source;

a pixel wire unit configured to provide the data signals to the pixels;

a demultiplexer formed between the driving voltage wire unit and the pixel wire unit and configured to electrically connect the driving voltage wire unit to the pixel wire unit; and a test unit configured to generate and provide a test data signal to the pixels, wherein the test unit is provided between the demultiplexer and the display unit, wherein the pixel wire unit includes a second wire configured to receive the driving voltage, each of the pixels has a driving transistor, and the second source/drain wire is connected to a source electrode of the driving transistor.

16. The display device of claim 15, wherein the driving voltage wire unit includes the first wire, and wherein the demultiplexer includes a third wire.

17. The display device of claim 16, further comprising a planarization layer formed over a portion of the first wire and a portion of the second wire, wherein the pixel wire directly contacts the first wire through a first via hole where the planarization layer is not formed, and wherein the pixel wire directly contacts the second wire through a second via hole where the planarization is not formed.

18. The display device of claim 17, wherein the planarization layer is further formed over the demultiplexer, and wherein the thickness of the planarization layer in the demultiplexer is greater than each of the thicknesses of the planarization layer formed over the first and second wires.

* * * * *